United States Patent [19]

Morony et al.

[11] Patent Number: 4,771,911

[45] Date of Patent: Sep. 20, 1988

[54] LIQUID CONTAINER HOLDER

[76] Inventors: Eugene W. Morony, Unit 1, 77 OG Road, Klemzig, Australia, 5087; Neville R. James-Burns, 23 Matilda Terrace, Para Hills, Australia, 5096; Gilbert J. Sare, 43 St Ann's Place, Parkside, Australia, 5063

[21] Appl. No.: 903,312

[22] Filed: Sep. 3, 1986

[51] Int. Cl.[4] ..... B65D 23/08; B65D 81/38

[52] U.S. Cl. ..... 220/408; 215/12.1; 220/410; 220/448; 220/903; 220/85 H

[58] Field of Search ..... 220/408, 410, 446, 448, 220/903, 85 H; 215/12 R, 13 R

[56] References Cited

U.S. PATENT DOCUMENTS

| | | | |
|---|---|---|---|
| 2,076,893 | 4/1937 | Johnson | 215/13 R |
| 3,275,180 | 9/1966 | Optner | 220/408 |
| 3,587,917 | 6/1971 | Trigilia | 215/13 R |
| 3,882,315 | 5/1975 | Soldan | 220/410 |
| 4,299,100 | 11/1981 | Crisman | 220/903 |
| 4,351,451 | 9/1982 | Charg | 215/13 R |
| 4,372,453 | 2/1983 | Branscum | 220/903 |

*Primary Examiner*—George E. Lowrance
*Attorney, Agent, or Firm*—Townsend & Townsend

[57] ABSTRACT

A holder for beverage containers which will tightly grip the container when positioned therewith but which is readily releasable to allow for easy removal of the container. The holder comprises a cup-like body for holding the beverage container, a rotatable locking ring and a deformable elastomeric clamping sleeve. The arrangement of the clamping sleeve and the locking collar is such that upon rotation of the locking collar in one direction the collar applies a compressing force against the clamping sleeve which causes a portion of the sleeve to deform radially inwards and to tightly grip against the container so as to frictionally retain the container therewith. Rotation of the locking collar in the other direction releases the compressive force thereby allowing release of the container.

11 Claims, 2 Drawing Sheets

LIQUID CONTAINER HOLDER

Figure 1:
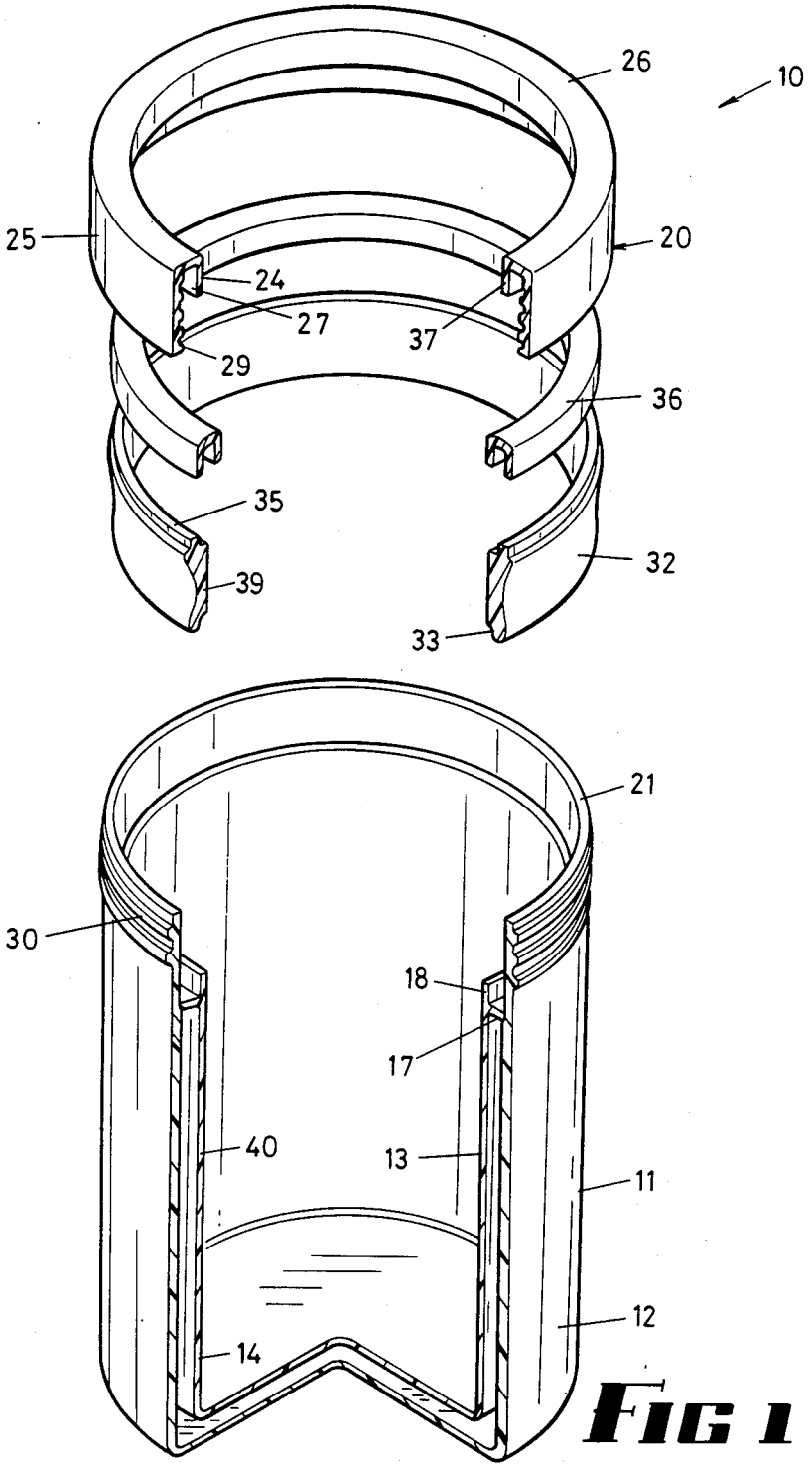

This invention to holders for containers, and in particular holders for cold beverage containers which will tightly grip the container when positioned therewithin but is readily releasable to allow for easy removal of the container.

The applicants are aware of a number of prior art container holders for holding cold beverage containers such as bottles and cans, and in this respect reference is made to Australian Patent specification No. AUA 83142/82 in the name of Cott Corporation and Australian Patent Application No. AUA 88642/82 in the name of Hanimex Pty, Limited. Each of the container holders disclosed in the aforementioned Patent specifications has the advantage of being able to accommodate containers of different sizes, it being appreciated that beverage containers such as bottles and cans can have different physical dimensions. Additionally, the prior art holders have been designed so as to minimize or prevent the circulation of ambient air around the container when positioned in the holder so that any undesirable heat exchange between the ambient air and the container is avoided. This has been achieved by substantially sealing off the annular air gap or space between the outer wall of the inserted portion of the container and the inner wall of the holder.

It is the main object of the present invention to provide improvements to a container holder which will firmly and releaseably grip the item being held and which is capable of releasably gripping containers of different sizes.

It is further object of the present invention to provide an improved container holder which will insulate the container from ambient conditions around the holder more efficiently than is the case with prior art holders.

It is a still further object of the present invention to provide an improved container holder which is of sturdy construction and which is designed to have a long working life.

According to this invention therefore, a container holder for holding beverage containers comprises a cup-like body having a bottom wall and a cylindrical side wall which terminates at its upper edge in a rim, a rotatable locking collar or ring located over said rim and having a central opening coaxial with said cup-like body, the central opening permitting a container to be inserted therethrough, an annular clamping sleeve locating ledge extending around the inner periphery of said cup-like body near its rim, a deformable elastomeric clamping sleeve seated on said ledge and having a cylindrical bore the diameter of which, when the clamping sleeve is in its undeformed condition, is approximately equal to the diameter of said central opening, the arrangement of the clamping sleeve and the locking collar being such that upon rotation of the locking collar in one direction, the collar applies a compressive force against the upper circular rim of the clamping sleeve which causes portion of the sleeve to deform radially inwards and to tightly grip against a container, when positioned in the holder so as to frictionally retain same therewithin; whilst rotation of the locking collar in the other direction relaxes the compressive force whereupon the clamping sleeve assumes its original undeformed condition.

Preferably, there is provided an annular slip or friction ring which snugly locates over the upper circular rim of said clamping sleeve, said slip ring inhibiting any twisting of the clamping sleeve when said collar is rotated in said one direction.

Preferably still, the locking collar, the slip or friction ring and the cup-like body are all moulded of synthetic plastics material, for example polypropylene, whilst the clamping ring is moulded of silicone rubber.

Preferbly still, the cup-like body of the holder is moulded as two parts and comprises an outer cup-like moulding and an inner cup-like moulding which nests inside of the outer moulding, there being an annular air gap or space between the two moulding, the inner moulding being formed with a radially outturned flange at or adjacent its open upper end which constitutes the ledge on which is seated the lower rim surface of the clamping ring. The air gap between the mouldings may be filled with a suitable insulative material to afford better thermal insulation.

Figure 2:
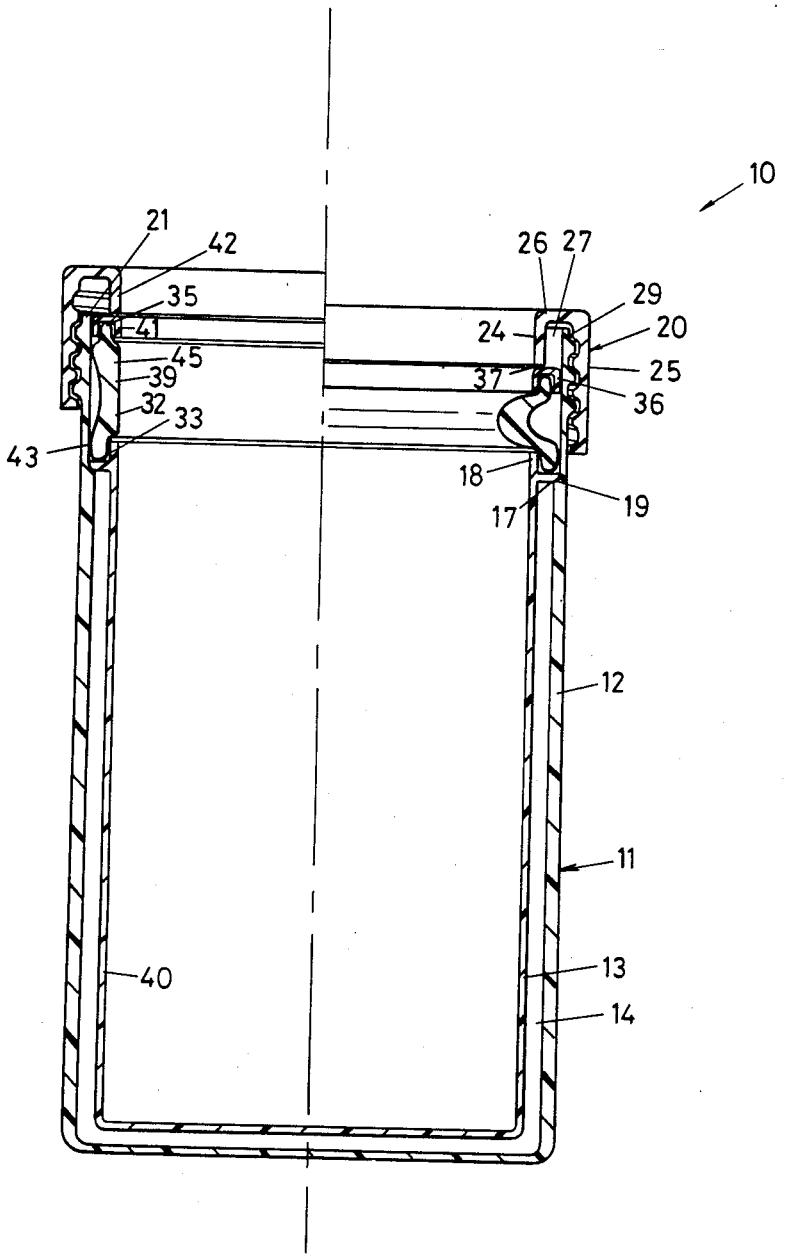

In order to more fully explain the applicants' invention, an embodiment is described hereunder in some further detail with reference to and illustrated in the accompanying drawings in which:

FIG. 1 is an exploded perspective (partly cut away) view of the holder according to a preferred embodiment, and FIG. 2 is a vertical cross-section taken through the holder, one half of the drawing showing the holder in its "container release" position, the other half showing the holder in its "container gripping" position.

In this embodiment, a container holder 10 for holding cold beverage containers such as bottles and cans comprises a generally cylindrical cup-like body 11 composed of an outer moulding 12 and an inner moulding (or liner) 13 which slips or nests inside of the outer moulding 12, the respective diameters of the mouldings being such that a small annular air gap 14 exists therebetween. The interior of the inner moulding 13 is formed so that is can easily accommodate a container (not shown). In this embodiment, the inner and outer mouldings 12, 13 are moulded of polypropylene.

The upper open end of the inner cup-like moulding 13 is formed with a radially outturned annular flange 17 which serves as a ledge, the flange 17 terminating at its radially inner end in an upstanding bead or rib 18 which extends around the rim of the inner moulding 13. The free peripheral edge surface of the outturned flange 17 abuts against a conical shoulder 19 which extends around the inner surface of the outer moulding 12 near its upper end, such an arrangement assisting to firmly locate the inner moulding 13 in position relative to the outer moulding 12.

An annular locking ring or collar 20 engages over the rim 21 of the outer cup-like moulding 12, the locking ring or collar 20 having inner and outer cylindrical side walls 24, 25 and an upper horizontal annular top wall 26 bridging the side walls 24, 25, the walls 24, 25 together defining an annular downwardly facing channel 27 for receiving the rim 21 of the outer moulding 12. In this embodiment, the depth (or height) of the inner side wall 24 is less than the depth of the outer side wall 25, the inner surface of the outer side wall 25 being provided with a threaded 29 which threadably engages a thread 30 formed on the outer surface of the outer moulding 12 adjacent its upper end, whereby the locking ring or collar 20 and the cup-like body 11 can be rotated relative to one another. In this embodiment, a multi-start thread formation is used so that a one-half turn of the locking collar 20 rotates same from its fully open to its fully closed position.

A resilient flexible clamping ring 32 which, int his embodiment, is moulded of elastomeric material, has its lower circular end surface 33 seated on the annular ledge 17, the upper circular end surface 35 of the ring 32 being snugly received inside an annular channel-sectioned friction of slip ring 36 which is contiguous with the bottom circular end face 37 of the inner side wall 24 of the locking ring or collar 20, the clamping ring 32, in its undeformed state, having an inner lateral wall 39 which lies flush with the inner surface 40 of the inner moulding 13 and also with the inner surfaces 41, 42 of the friction ring 36 and the locking ring of collar 20. The locking ring 20, the slip ring 36 and the clamping ring 32 are all co-axially aligned.

In this embodiment, the clamping ring 32 has a concavely curved outer lateral surface 43 so as to form a central ring portion 45 of reduced thickness, the shape of the ring being designed to allow the central ring portion 45 to readily flex radially inwardly into the interior of the holder upon the ring 32 being squeezed between the collar 20 and the ledge 17. By using a elastomeric clamping ring which is able to flex or distort appreciable distance, the ring 32 will accommodate and releasably grip containers of different diameters' within an appreciable range and at the same time ensure that a proper seal is maintained between the outer surface of the container and the clamping ring, this in turn ensuring that the air space or gap between the container and the inner cup-like moulding is sealed off from ambient air.

In use, a container such as a bottle or can is inserted through the opening presented by the locking collar/-slip ring/clamping ring assembly into the bore of the cup-like body 11 with at least a portion of the container projecting from the open end of the holder 10. The container is inserted with the clamping ring 32 in its undeformed condition. The locking ring or collar is then rotated in one direction so as to apply an axial compressive force to the slip ring located thereunder and in turn squeeze or compress the clamping ring between the slip ring and the ledge, this causing the clamping ring to flex inwardly so that is inner lateral wall resiliently grips and seals against the outer surface of the container.

When it is desired to release the container, the locking ring or collar is rotated in the opposite direction so as to return the elastomeric clamping ring to its original undeformed condition and in turn allow for the quick and easy removal of the container.

A brief consideration of the above embodiment will indicate that the invention is relatively simple but nevertheless provides for a container holder which affords vastly improved thermal insulation in comparison to prior art holders, this being in essence due to the presence of the deformable elastomeric clamping ring which is able to effectively isolate and insulate the container from ambient conditions around the holder. In addition, by having an air gap not only between the container and the inner cup-like mouldings, far better thermal insualtion is afforded.

The claims defining the invention are as follows.

We claim:

1. A holder for holding beverage containers, for example, cans and bottles, comprising:

a cup-like body having a bottom wall and a cylindrical wall which terminates at its upper edge in a rim, a rotatable locking collar or ring located over said rim and having a central opening coaxial with said cup-like body, the central opening permitting a container to be inserted therethrough, an annular clamping sleeve locating ledge extending around the inner periphery of said cup-like body near its rim, a deformable elastomeric clamping sleeve seated on said ledge and having a cylindrical bore the diameter of which, when the clamping sleeve is in its undeformed condition, is approximately equal to the diameter of said central opening, the clamping sleeve having a concave outer lateral surface, the arrangement of the clamping sleeve and the locking collar being such that upon rotation of the locking collar in one direction, the collar applies a compressive force against the upper circular rim of the clamping sleeve for pressing the clamping sleeve against the ledge which causes a portion of the sleeve to bend radially inwardly and to tightly grip against a container, when positioned in the holder, so as to frictionally retain the same therewith, whilst rotation of the locking collar in the other direction relaxes the compressive force whereupon the clamping sleeve is able to assume its original undeformed condition.

2. A holder according to claim 1 further comprising an annular slip ring which snugly locates over the upper circular rim of said clamping sleeve, said slip ring inhibiting any twisting of the clamping sleeve when said collar is rotated in said one direction.

3. A holder according to claim 2 wherein said collar has an inner annular lateral wall projecting into said cup-like body through its open upper end and an annular outer lateral wall extending from the top wall of the collar down the outside of the cylindrical side wall of the body, the lower end surface of said inner lateral wall being arranged to abut against the upper annular surface of said slipring, and wherein the internal diameter of said slipring is approximately equal to the diameter of said central opening defined by said inner lateral wall.

4. A holder according to any preceding claim wherein said cup-like body comprises an outer cup-like moulded body part and an inner cup-like moulded body part which nests inside of said outer moulded part, there being an annular gap or space between said moulded parts, the rim of the inner moulded part terminating in a radially outturned annular flange which constitutes the ledge on which is seated the lower rim surface of the clamping sleeve.

5. A holder according to claim 4 wherein the inner cylindrical surface of the clamping sleeve, when in its undeformed condition, lies flush with the inner cylindrical wall of said inner cup body member.

6. A holder according to claim 4 wherein the inner cylindrical wall of said outer moulded body part is provided with an annular shoulder near its open upper end, said outturned flange being seated on said shoulder, the location of said shoulder and the height of said inner moulded body part being selected so that with the inner member nested within the outer moulded member, a space or gap exists between the bottom walls of said inner and outer moulded body parts.

7. A holder according to claim 4 wherein the inner surface of the outer lateral wall of said locking collar or ring is provided with a thread which threadably engages a thread formed on the outer surface of said outer moulded body part adjacent its upper end, whereby the locking ring or collar and its cup-like body can be rotated relative to one another.

8. A holder for beverage containers comprising:

a cup-shaped body having a bottom wall and a cylindrical side wall which terminates at its upper edge in a rim;

a locking member disposed over the rim and having a central opening coaxial with the cup-shaped body, the central opening permitting a container to be inserted therethrough;

means for selectively moving the locking member toward or away from the rim;

an annular ledge extending around the inner periphery of the cup-shaped body; and an elastomeric clamping sleeve disposed between the ledge and the locking member and seated on the ledge, the clamping sleeve having a concave outer lateral surface; and means for applying a compressive force to the top of the clamping sleeve for pressing the clamping sleeve against the ledge and for radially inwardly being in the clamping sleeve when the locking member is moved toward the rim.

9. The holder according to claim 8 wherein the locking member threadingly engages the rim for forming the moving means, so that the locking member selectively moves toward or away from the rim when the locking member is rotated relative thereto.

10. The holder according to claim 8 further comprising a slip member disposed between the clamping sleeve and the locking collar for slidably contacting the locking collar when the locking member is rotated relative to the cup-shaped member.

11. A holder for beverage containers comprising:

a cup-shaped body having a bottom wall and a cylindrical side wall which terminates at its upper edge in a rim;

a locking collar threadingly engaging the rim for selectively moving the locking collar toward and away from the rim when the locking collar is rotated relative thereto, the locking collar having a central opening coaxial with the cup-shaped body for permitting a container to be inserted therethrough;

an annular ledge extending around the inner periphery of the cup-shaped body;

an annular elastomeric clamping sleeve disposed between the ledge and the locking collar and seated on the ledge, the clamping sleeve having a concave outer lateral surface;

a slip ring disposed between the clamping sleeve and the locking collar and seated on the clamping sleeve, the slip ring slidably contacting the locking collar when the locking collar is rotated relative to the rim;

wherein the slip ring presses the clamping sleeve against the ledge when the locking collar is moved toward the rim, and the concave outer lateral surface of the clamping sleeve causes the clamping sleeve to collapse and bend radially inwardly for grasping the container.

* * * * *